United States Patent [19]

Bogner et al.

[11] 3,958,247

[45] May 18, 1976

[54] RF POWER COUPLING NETWORK EMPLOYING A PARALLEL PLATE TRANSMISSION LINE

[75] Inventors: Bruce Fredric Bogner, Mount Holly; David Francis Bowman, Moorestown, both of N.J.

[73] Assignee: RCA Corporation, New York, N.Y.

[22] Filed: Dec. 23, 1974

[21] Appl. No.: 535,814

[52] U.S. Cl. ..... 343/754; 343/854; 333/6; 333/81 B

[51] Int. Cl.[2] ..... H01Q 3/26; H01Q 17/00

[58] Field of Search ..... 333/81 B, 6; 343/754, 343/854

[56] References Cited

UNITED STATES PATENTS

| | | | |
|---|---|---|---|
| 2,877,434 | 3/1959 | Farr et al. | 333/81 B |
| 3,524,151 | 8/1970 | Safran | 343/754 |
| 3,852,761 | 12/1974 | Bogner | 343/754 |

*Primary Examiner*—Eli Lieberman

*Attorney, Agent, or Firm*—Edward J. Norton; Robert L. Troike

[57] ABSTRACT

A pair of conductive circular plates are positioned in a parallel spaced relationship. A conductive ring-like band extending about the periphery of the plates forms an enclosed parallel plate transmission line. A coupling member is located at the center of this enclosed transmission line. A plurality of peripheral coupling members to the transmission line are spaced radially from and in a ring-like pattern about the center coupling member. A plurality of radio frequency (RF) power absorption members are coupled to the transmission line at the regions between the peripheral coupling members to reduce radio frequency signal coupling between the peripheral coupling members.

11 Claims, 6 Drawing Figures

RF POWER COUPLING NETWORK EMPLOYING A PARALLEL PLATE TRANSMISSION LINE

BACKGROUND OF THE INVENTION

This invention relates to a radio frequency power coupling network and more particularly to such a network using a parallel plate transmission line.

A parallel plate transmission line used as part of a lens feed for an antenna array system is described in applicants' U.S. Pat. No. 3,827,055. The system described in the patent is an efficient way of beam steering through 360° in fine increments or continuously. The parallel plate transmission line in the system of the above cited patent has a central set of coupling members for propagating in the transmit mode directional signals inside the parallel plate transmission line and a second set of coupling members located in a ring-like pattern about the first set of coupling members responsive in the transmit mode to the signals in the line. The outer coupling members of the second set are coupled via transmission lines to radiating antenna elements. The energy distribution provided by the inner or central set of coupling members controls the energy distribution to the second set of coupling members. If a load mismatch at any one of the radiating antenna elements occurs, reflections from the one mismatched radiating antenna element may cause the connected one of the second set of coupling members to radiate power in the parallel plate transmission line, causing an unwanted change in the power distribution within the parallel plate transmission line. In particular, this undesirable power distribution results from radiation by one of the second set of coupling members being picked up by adjacent coupling members of the second set of coupling members.

A problem in state-of-the-art radio frequency power dividers has been the provision for equal dividing of the power from a given source to any selected number of loads with a high degree of isolation between the loads and with a low insertion loss. Power combiners are also difficult to design with respect to isolation between sources, insertion loss, and the freedom to select the number of sources to be combined. It is desirable that power combiner and power divider networks operate at relatively high power levels. Conventional power combiner and power divider networks using conventional hybrids such as magic tee and short-slot hybrids become increasingly lossy and inefficient as the number of sources or loads increases. For example, where the power from twenty sources are combined, adding an extra source or two more or even doubling the number of sources may produce only a negligible increase in power. Likewise, power division by using a plurality of hybrids can be very lossy.

BRIEF DESCRIPTION

A transmission line power coupling network includes a pair of parallel conductive plates spaced from each other with a dielectric medium therebetween and a conductive ring-like band extending about the periphery of the plates. A coupling member is located at the center of the enclosed transmission line to provide one terminal of the network. A plurality of coupling members are spaced radially and in a ring-like pattern about the centrally located coupling member, the network providing coupling of signal energy between the one terminal provided by the centrally located coupling member and the plurality of terminals provided by the plurality of radially located coupling members. The plurality of radially located coupling members are isolated from one another by members positioned to absorb radio frequency energy propagating between the radially located coupling member.

DETAILED DESCRIPTION

A detailed description follows in conjunction with the following drawings.

Figure 1:
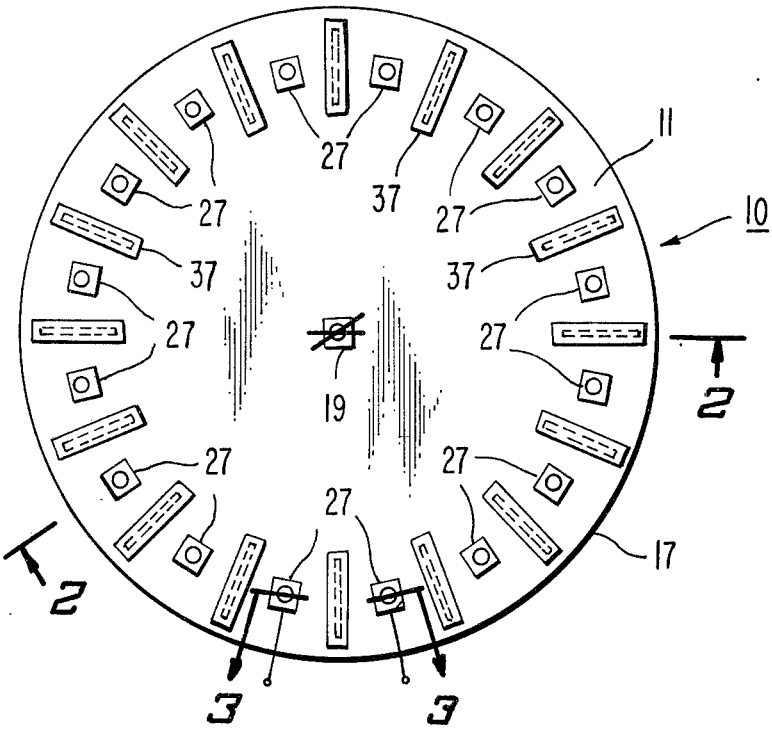
FIG. 1 is a sketch of a power divider/combiner network according to one embodiment of the present invention.
Figure 2:
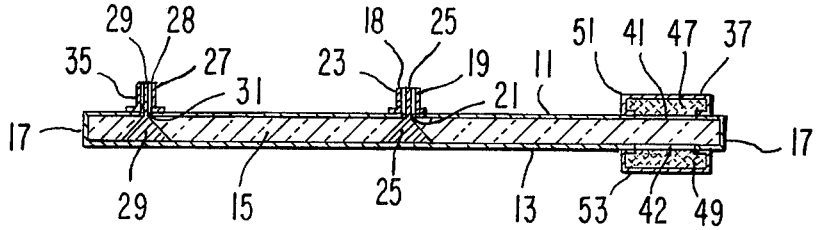
FIG. 2 is a sketch of the power divider/combiner network in FIG. 1 showing a cross-section taken along line 2—2 in FIG. 1.
Figure 3:
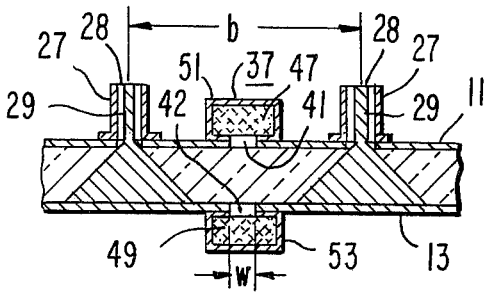
FIG. 3 is a sketch of the power divider/combiner network in FIG. 1 showing a cross section taken along line 3—3 in FIG. 1.

Referring to FIGS. 1 and 2, a parallel plate enclosed transmission line 10 includes a pair of circular parallel conductive plates 11 and 13 spaced by a dielectric medium 15 therebetween. A metal band 17 extends around the periphery of the metal plates 11 and 13. The dielectric medium may be air or in this preferred example is a body of dielectric material. At the center of the transmission line 10 is provided a coupling probe 19. The coupling probe 19 is a coaxial type probe wherein the center conductor 25 beginning at terminal 18 extends through an aperture 21 in plate 11 and through dielectric medium 15 to plate 13. The outer conductor 23 is connected to the plate 11. The inner conductor 25 may be cone-shaped in the area of the dielectric medium 15 as illustrated. Sixteen similar, coaxial, probes 27 are located near the metal band 17 at the periphery of the transmission line 10. The peripheral probes 27 are arranged normally with uniform intervals in a ring-like circle equidistant from the central coupling member 19. The peripheral probes 27 include a center conductor 29 extending from a terminal 28 through an aperture 31 in plate 11 and through the medium 15 to the plate 13. The center conductor 29, as in the case of conductor 25, may have a conical taper in the area of the dielectric medium 15 so as to improve a match between the peripheral probes 27 in the dielectric medium 15, and coaxial transmission lines, not shown, coupled to these probes. The outer conductor 35 of the peripheral probe 27 is coupled to plate 11. An RF power absorbing member 37 is located between each adjacent pair of peripheral probes 27. In the embodiment illustrated in FIGS. 1 and 2, there is a total of 16 RF power absorbing members 37. Each RF power absorbing member 37 is centered between adjacent peripheral probes 27 along the ring-like circle of these probes 27 in a manner to absorb signal energy propagating between the corresponding peripheral probes 27. The RF power absorbing member 37 as illustrated in FIGS. 1, 2 and 3 includes narrow slots 41 and 42, extending in the radial direction in the plates 11 and 13 respectively. Radio frequency absorbing material 47 and 49 is placed adjacent slots 41 and 42, respectively. This absorbing material is placed across the slots on the outside surface of the transmission line 10. This absorbing material is enclosed in a conductive shielding cavity 51 and 53. Each cavity is coupled through the respective slot 41 or 42 only to the transmissions line 10. The slot width w (illustrated in FIG. 3) is made sufficiently wide to couple electromagnetic energy propagating between the peripheral probes 27 out of the transmission line 10. Radio frequency energy coupled through the slots is absorbed in the material 47 and 49 and is prevented from being radiated outside the system by the shielded boxes 51 and 53. By way of example, the network may include as the dielectric medium 15 Z-tron "G" material manufactured by the Polymer Corporation of Reading, Pennsylvania. For a system operating between 1030 and 1090 Megahertz (MHz), the height of the dielectric body may be on the order of ⅜ inch. The diameter of the plates is about 12-¾ inches. The parallel plate transmission line structure and the inner and outer probes may be similar to that described in applicants' previously mentioned patent. The power absorbing material 47 and 49 may be Eccosorb sold by Emerson & Cuming, Inc., of Canton, Massachusetts. The cavity dimensions for this example may be ½ inch wide, ¼ inch high and 3 inches long. The slots may be 1/32 inch wide and 2-⅓ inches long when the operating frequency of the antenna is centered at about 1060 MHz. The plate spacing should be less than one half wavelength in the dielectric medium where this wavelength is at an operating frequency of the antenna. The peripheral probes should preferably be spaced inward from the circumferential band 17 about one quarter wavelength in the dielectric medium 15. The relationship among *b*, the adjacent peripheral probe spacing as measured circumferentially as viewed in FIG. 3; *a*, the parallel plate spacing; $R_o$, the characteristic impedance (in ohms) of the transmission lines or circuits associated with the peripheral probes; and *k*, the relative dielectric constant of the medium 15 should be approximately:

$$R_o = 120\ \pi a/b\ \sqrt{k}$$

For the example illustrated, the peripheral probes 27 are spaced about 1.8 inches apart on a 4.5 inch radius from the center of the radial transmission line. The outer peripheral probes 27 are located about 1-⅞ inches from the band 17. The coupling probes have a characteristic impedance of 50 ohms. The transverse cross-sectional dimension of the absorber cavity should be approximately at a resonant condition (although highly damped by absorber action) at the center of the intended frequency band of operation. This resonance is determined by a combination of the dimensions and the characteristics of the absorbing material, particularly its dielectric constant and magnetic permeability.

The slot length should be such as to be approximately half wave resonant at the center frequency of operation of the antenna system in the composite medium including the medium of dielectric body 15, and absorbing material 47 and 49. Also, this half wave resonant length may include integral numbers of half wavelengths.

In the operation of this network as a power divider, input signals are coupled to the center probe 19 via terminal 18 and the output signals are taken at the peripheral probes 27 via terminals 28. In response to the input signals to the probe 19, RF energy is excited radially from the center of the transmission line in the TEM mode and the resulting pattern is omni-directional. This radiated omni-directional pattern is picked up at the peripheral probes 27 and substantially equal power and in phase signals are coupled from the respective output terminals 28 of probes 27. In this arrangement a sixteen to one power division is achieved. In a similar manner the outer probes may be any number such as 48 probes as described in the previously cited patent. A selected fixed power division is achieved without significant added losses with higher power division ratios. The system also operates in a reciprocal manner (as a combiner) such that each of the peripheral probes 27 can be coupled at terminals 28 to an RF energy source. The system in response to signals from these sources causes energy to radiate from the probes 27 within the radial transmission line and the combined power is coupled out of the line at the central probe 19. By the addition of the RF absorbing members located between the adjacent peripheral probes 27, the RF coupling between these peripheral probes is significantly reduced to enable this type of combining operation.

Figure 4:
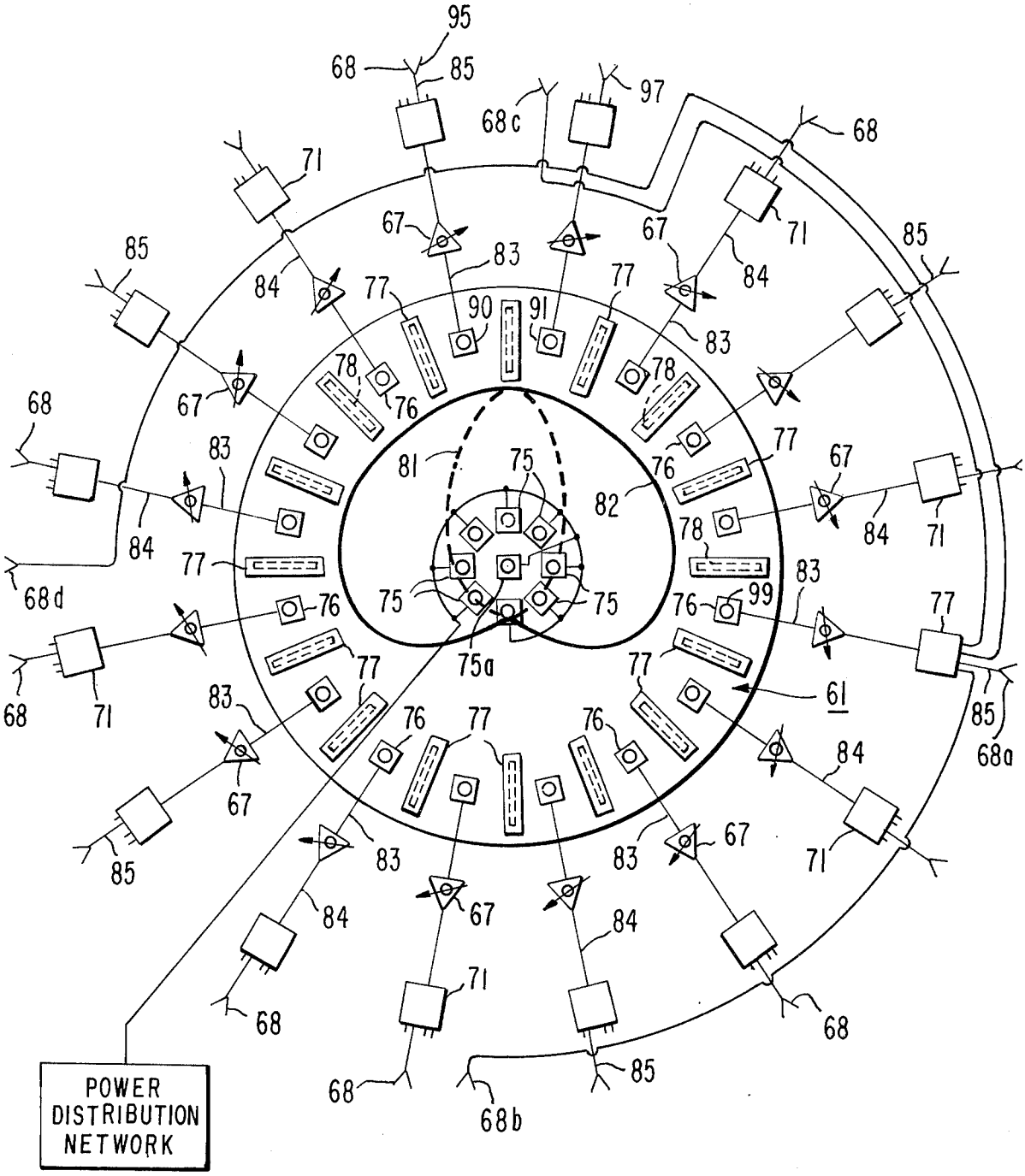
FIG. 4 is a sketch of an improved lens fed antenna array system.

As discussed in the previously cited patent, this general type of radial transmission line is useful for providing a 360° scanning antenna system. The radial transmission line when used in the arrangement illustrated in FIG. 1 of the cited patent is located in the center of the system with the outer peripheral probes coupled via phase shifters and transmission lines to radiating elements arranged concentrically about the radial transmission line. In the arrangement illustrated in FIG. 1 of this cited patent, the number of outer probes used was 48. For purposes of illustration in FIG. 4 of the present disclosure, only 16 outer probes 76 are illustrated. The radial transmission line 61 in FIG. 4 of the present invention is like that discussed previously wherein the transmission line comprises a pair of circular conductive plates spaced parallel to each other with a dielectric medium therebetween and a metal band extending about the periphery of the metal plates. As discussed previously, there are sixteen outer probes 76 near the periphery of the radial transmission line 61. These peripheral probes may be arranged and be like that described above in connection with probes 27 in FIGS. 2 and 3. Between each of the peripheral probes 76 is an RF power absorbing member 77. The RF power absorbing member 77 is like the RF power absorbing members 37, illustrated in FIGS. 1, 2 and 3 and discussed in connection therewith. Each of the RF absorbing members 77 comprise a slot 78, in the top plate or the bottom plate or both, of the transmission line 61 with an RF absorbing material located on the outside surface of the plates above or below the slots. A conductive enclosure surrounds the RF absorbing material to form a cavity coupled to the line only as discussed previously and illustrated in FIGS. 2 and 3. The slots 78 is illustrated in FIG. 4 have their long dimension extending in the radial direction to present minimum coupling to the signals radiated to and from the center of the transmission line and maximum coupling to signals propagating between the peripheral probes 76. At the center of the radial transmission line are a plurality of coupling probes 75 which probes, when signals are coupled probes 75 which probes, when signals are coupled thereto in a given power and phase relationship, excite a directional signal within the transmission line 61. These centrally located or inner probes are, for example, like the peripheral probes previously discussed. This phasing of the signals coupled to these centrally located probes 75 is discussed in applicants' previously cited patent. In one embodiment discussed in applicants' above cited patent, this pattern with many centrally located probes 75 produces a very directional pattern wherein only a selective few of the peripheral probes are excited upon energization of the centrally located probes. Each of the outer probes 76 is coupled through a phase shifter 67 to a radiating element 68 via transmission line sections 83, 84 and 85. In one arrangement there may be a radiating element and a phase shifter for each of the outer probes 76. By altering the power distribution and phase to the central probes 75, the directional pattern is produced. This directional pattern as illustrated by dashed lines 81, excites probes 90 and 91 for example with maximum power with minimum power to the oppositely and orthogonally oriented peripheral probes. This causes most of the power to be radiated out of radiating elements 95 and 97 with the orthogonally and oppositely oriented peripheral probes 76 receiving little or no energy and therefore a beam pointing primarily in the direction of elements 95 and 97 is produced out of the antenna system. The RF absorbing members 77 are spaced a sufficient distance from the center so that the fields in the radial transmission line appear to extend in substantially the radial direction even though the fields are directive. This distance is also a requirement for the spacing of the peripheral probes from the center of the transmission line, hence, they are illustrated the same radial distance from the center. Although only 16 peripheral probes, 16 phaser shifters and 16 radiating elements are illustrated, any number of peripheral probes, phase shifters, and radiating elements may be used such as 48 or 192 for the arrangements discussed in applicants' patent cited previously.

One may wish to use the system discussed in connection with FIGS. 4 through 13 in the cited patent requiring a less directional beam within the radial transmission line. The pattern produced in this system is a cardiod pattern as illustrated by line 82, in FIG. 4 herein. This cardiod pattern is achieved using nine inner coaxial probes 75. N-way switches 71 as illustrated herein in FIG. 4, are coupled between the phase shifters 67 and the radiating elements 68 and between transmission line sections 84 and 85. These switches are used to switch power between different radiating elements radiating in different azimuthal directions of the 360° scan. These switches operate in the same manner as the switches 71 in the cited patent. For example, in the arrangement shown in FIG. 4 herein, the particular four-way switch 77 has an input coupled to a given peripheral probe 99 and an output coupled to four radiating elements 68*a*, 68*b* 68*c* and 68*d*, where these four radiating elements are equally distributed about the array such that a given peripheral probe couples energy to a selected radiator in one of four quadrants of the array. Each of four-way switches 71 would be similarly connected to four radiating elements. The phase shifters 67 provide the required relative phases among the radiating elements. A further description of this switching arrangement can be found in the applicants cited patent.

Figure 5:
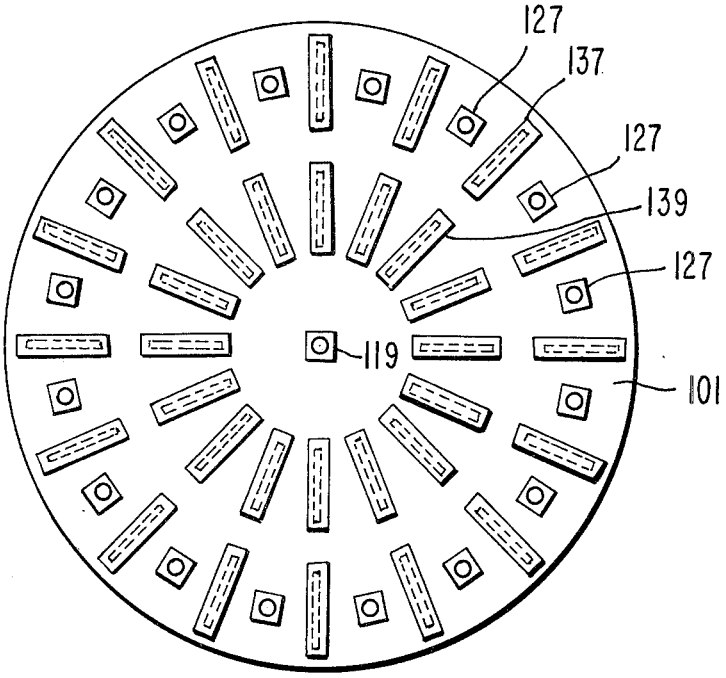
FIG. 5 is a sketch of another embodiment of the present invention.
Figure 6:
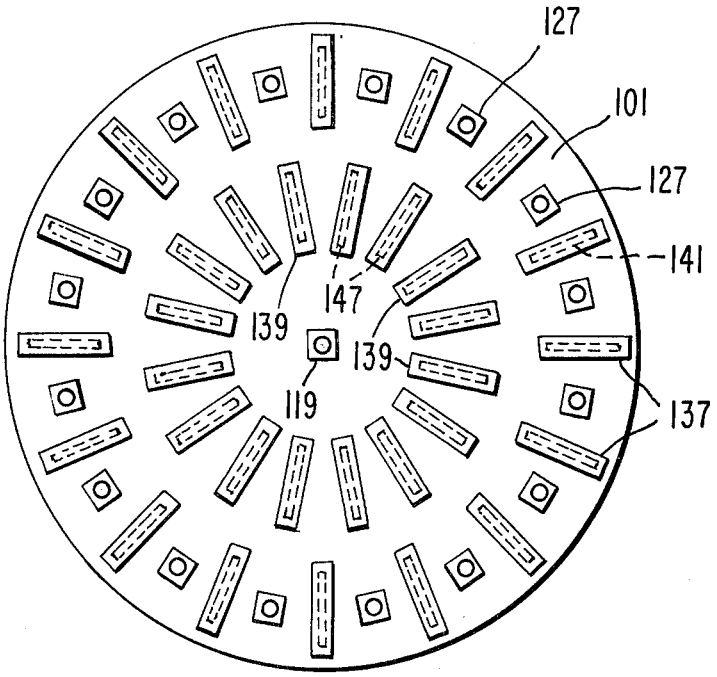
FIG. 6 is a sketch of still another embodiment of the present invention.

Referring to FIG. 5, there is illustrated a further embodiment of the invention for preventing coupling between the peripheral probes when the system is a power divider or power combiner network. In FIG. 5, there is illustrated a radial transmission line 101 which is like that discussed herein in connection with FIGS. 1 through 3 including a central probe 119. A plurality of outer peripheral probes 127 are normally equally spaced and arranged in a ring-like pattern and coaxial with the central probe 119. These outer probes 127 are arranged and are like that discussed in connection with FIGS. 1 through 3. Between each pair of adjacent outer probes 127 is an RF absorbing member 137. These absorption members are like those discussed previously in connection with FIGS. 1 through 3 and include a slot 141 in the parallel plates of the radial transmission line and RF absorbing material located on the plates over each of the slots on the outside surface of the line. RF shielding may be provided by encapsulating the RF absorbing material as illustrated in FIGS. 2 and 3. In order to further reduce coupling between alternate peripheral probes 127, a second ring of RF absorbing members 139 is used which ring of RF absorbers is concentric with the ring of RF absorbers 137 and may as shown in FIG. 5, extend along the same radial axes as the RF absorbers 137. The slot 147 of each absorber 139 in the parallel plates is colinear with the slot 141 in a corresponding RF absorber 137. Similarly, RF absorbing material is located over each of the slots 147 and outside of the radial transmission line and the absorbing material may be encapsulated by a shield. Alternatively, the absorbing members 139 and their slots 147 may have their long axes, as illustrated in FIG. 6, pass through the locations of the peripheral probes 127. The absorbing members 139 in FIGS. 6 present neglible effect on the desired signal coupling between the central probe and the peripheral probes 127 because the slots are made very narrow in the radial direction. Also, the number of RF absorbing members 139 may be different from the number of RF absorbing members 137. In the case of the lens fed array with a directional beam, this inner ring of absorbing members may be too close to the center and the field would not be radial enough to prevent absorption of the desired signal.

In the system described above, the probes need not necessarily be conical or connected to the opposite plate. All of the peripheral probes need not enter the radial transmission line on the same side. They could alternate sides, for example. The peripheral probes and the central probe or probes could enter from opposite plates. The RF absorbers need not necessarily be present on both sides of the radial transmission line.

What is claimed is:

1. A network for coupling radio frequency signals between a plurality of terminals and a single terminal comprising:

an enclosed transmission line including a pair of conductive plates spaced parallel to each other with a dielectric medium therebetween and with a conductive ring-like band about the periphery thereof.

a centrally located coupling member coupled to said single terminal and in communication with the center of said enclosed transmission line, a plurality of coupling members coupled to said plurality of terminals and in communication with said enclosed transmission line at points spaced radially from and in a ring-like pattern about said center of said enclosed transmission line, and means including a plurality of narrow slots in at least one of said plates of absorbing radio frequency energy propagating between said plurality of coupling members.

2. The combination claimed in claim 1 wherein said narrow slots are arranged in a ring-like pattern.

3. The combination claimed in claim 2 wherein said narrow slots have a lengthwise axis extending in a radial direction and are spaced with a slot centered between each adjacent pair of said plurality of coupling members.

4. The combination claimed in claim 1 wherein RF absorbing material is placed over each of said slots on the outside surface of said transmission line.

5. The combination claimed in claim 1 wherein said slots are arranged in first and second ring-like patterns coaxial with each other.

6. The combination claimed in claim 5 wherein the lengthwise axis of said slots in said first and second ring-like patterns are aligned and extend in a radial direction.

7. The combination claimed in claim 5 wherein the lengthwise axis of each said slot in said second ring-like pattern is aligned in the radial direction between the center of the line and one of said plurality of coupling members.

8. A system for power dividing signals comprising;

an enclosed radial transmission line including a pair of conductive plates spaced parallel to each other with a dielectric medium therebetween and a conductive ring-like band about the periphery thereof, coupling means responsive to input signals for generating waves within said transmission line propagating radially omnidirectionally from the center of said transmission line, a plurality of coupling members coupled to said transmission line at points spaced radially from and in a ring-like pattern about said coupling means for providing a plurality of power divided outputs, and means including a plurality of narrow slots in at least one of said plates for absorbing radio frequency energy propagating between said plurality of coupling members.

9. A system for combining signals from a plurality of sources to a common output comprising:

an enclosed radial transmission line including a pair of conductive plates spaced parallel to each other with a dielectric medium therebetween and a conductive ring-like band about the periphery thereof;

a plurality of coupling members coupled to said radial transmission line at points spaced radially from and in a ring-like pattern about the center of said transmission line, said plurality of coupling members being adapted to be coupled to said sources for in response to energy from said sources radiating electromagnetic waves within said transmission line toward the center of said transmission line, coupling means located at the center of said ring-like pattern and said transmission line and responsive to said waves for coupling combined waves to said common output, and means including a plurality of narrow slots in one of said plates for absorbing radio frequency energy propagating between said plurality of coupling members.

10. In an antenna array system including an enclosed transmission line including a pair of parallel conductive plates spaced parallel to each other with a dielectric medium therebetween and with a conductive ring-like band about the periphery thereof, a first plurality of coupling members in communication with and clustered near the center of the enclosed transmission line to produce a given electromagnetic wave energy distribution within said line with maximum power emanating from the center of said enclosed transmission line in only selected radial directions in a plane substantially parallel to said plates, a second plurality of coupling members in communication with said enclosed transmission line and spaced radially from and in a ring-like pattern about said first plurality of coupling members, said second plurality of coupling members being disposed in a radial direction from said first plurality of coupling members a distance to cause only selected ones of said second plurality of coupling members to be appreciably excited in response to said given electromagnetic wave energy distribution, a plurality of radiating elements, means coupling each one of said radiating elements to a selected one of said second plurality of coupling members whereby in response to said given electromagnetic wave energy distribution a given radiated pattern from said radiating elements is excited, and means for changing said given electromagnetic energy distribution to change the radiated pattern from said radiating elements, the improvement therewith of means including a plurality of narrow slots in one of said plates for absorbing radio frequency energy coupling between said second plurality of coupling members.

11. The combination claimed in claim 10 wherein said narrow slots have a lengthwise axis extending in a radial direction and are spaced with each slot centered between an adjacent pair of said second plurality of coupling members, and said means for absorbing includes RF absorbing material placed over each of said slots on the outside surface of said radial transmission line.

* * * * *